US005469990A

United States Patent [19]

Wodeslavsky

[11] Patent Number: 5,469,990

[45] Date of Patent: Nov. 28, 1995

[54] SELF CLEANING LIQUID SOAP DISPENSER

[76] Inventor: Josef Wodeslavsky, #5 Peter Lynas Ct., Tenafly, N.J. 07670

[21] Appl. No.: 282,318

[22] Filed: Jul. 29, 1994

[51] Int. Cl.[6] ..... B67D 5/42

[52] U.S. Cl. ..... 222/148; 222/321.9; 137/240

[58] Field of Search ..... 222/148, 321.1, 222/321.7, 321.9, 192, 382; 137/240

[56] References Cited

U.S. PATENT DOCUMENTS

| | | | |
|---|---|---|---|
| 4,572,230 | 2/1986 | Mirabile | 222/148 |
| 4,801,049 | 1/1989 | Thompson | 222/382 |
| 5,090,440 | 2/1992 | Ladouceur et al. | 222/148 |

*Primary Examiner*—Andres Kashnikow
*Assistant Examiner*—Philippe Derakshani

[57] ABSTRACT

A self cleaning liquid soap dispenser which rinses the internal parts of the soap dispenser each time soap is ejected from the nozzle. The dispenser, being adapted to be connected to a pressurized water line comprises: a liquid soap tank containing liquid soap, a piston terminating in a nozzle, a cylinder which slidingly receives the piston, and a valve inside the cylinder, for providing selective communication between the dispenser and the pressurized water line. Whenever the piston will be pressed against the valve, pressurized water from the water line will rush into the piston pushing the soap in the cylinder out through the nozzle. The pressurized water will rinse the valve, the cylinder, the nozzle and the piston.

10 Claims, 4 Drawing Sheets

SELF CLEANING LIQUID SOAP DISPENSER

BACKGROUND OF THE INVENTION

1. Field of the Invention

This invention relates to liquid soap dispensers which are installed in sinks or wherever there is a water line and which are provided with a refillable soap tank. This invention provides an apparatus which will self clean each time the dispenser is used, keeping the device free of hard soap clots or dirt. Thus this device will prevent the malfunctions that occur in conventional liquid soap dispensers that are caused by the accumulation of hard soap inside the valves second cylinder and piston. Also, this invention will provide means for diluting the soap prior to its ejection, thus providing a single mechanism that wets the sponge and ejects the soap.

2. Description of the Related Art

Prior art provides liquid soap dispensers to be used in sinks where the soap tank is mounted below the sink and a plunger projects above the sink to be pressed each time soap is needed. The major problem all such soap dispensers have lies in the innate quality of liquid soap—its tendency to dry and plug the piston, prevent valves from moving and sticks the piston to the cylinder. Thus most such dispensers do not eject soap each time the plunger is pressed and consequently require regular cleaning.

SUMMARY OF THE INVENTION

My invention is an apparatus which can clean itself each time the dispenser is used. The device is adapted to a pressurized water line, which will provide pressurized water to wash the cylinder piston and all the valves situated between the water line and the soap tank. In a first position, the device can be in used as a regular soap dispenser, ejecting soap exclusively. In a second position, the device can eject soap and continuously eject pressurized water to clean the valves, cylinder the piston and the piston passage. In a third position, the device can eject soap and a limited amount of water. The device has either a single function for cleaning, in which case the soap will be diluted minimally, or the device can serve a second function which is a mechanism for providing water and soap in one step, in which case the soap can be diluted further, to different extents.

DESCRIPTION OF THE PREFERRED EMBODIMENT

Figure 1:
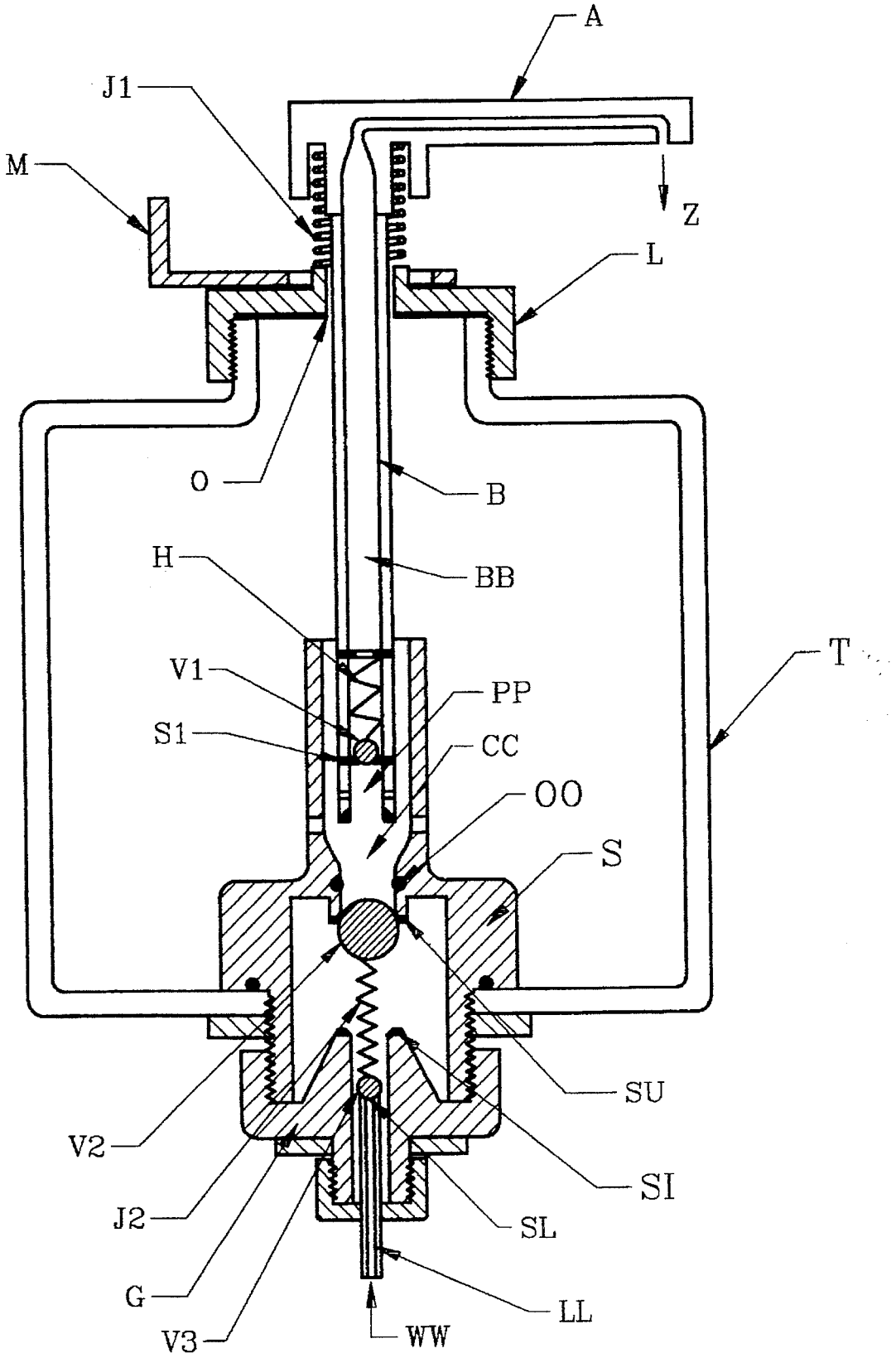
FIG. 1 illustrates the apparatus where the plunger is not pressed.

FIG. 1 will illustrate the apparatus which consists a soap tank T, having an opening O at the top to allow refilling the tank with soap. A plug L is adopted at the top exterior of the tank. A plunger B has a bore BB through it terminating in a nozzle Z. The nozzle Z is projecting out from the tank T through opening O. A button A is mounted on the plunger B for pressing the plunger B down. A spring J1 is placed below button A which will return plunger B to a none pressed position after button A is released. A projecting member M is mounted on the tank T to act as a stopping device: preventing button A from being pushed down against plug L, and therefore preventing plunger B from traveling down all the way. A piston PP having a bore H through it is mounted at the bottom of plunger B, bores BB and H forming a continuous passage for fluid to flow. A sleeve S is mounted in the tank T below the opening O for receiving and passing the piston PP. The lower portion of sleeve S is a cylinder CC for closely receiving piston PP. The bottom tip of piston PP is grooved to allow water to enter into piston PP when piston PP is pressed against valve V2 [to be described below]. Cylinder CC is connected to a valve body G, which is adapted to be connected to water line WW via adapter LL. A valve V1 seated on seat S1 at the lower end of piston PP allowing fluid to move in one direction—up from cylinder CC into piston PP and out of nozzle Z. Valve V1 will block the soap from going back to the tank T once button A will be released. The bottom of cylinder CC comprises a valve seat SU where valve V2 is mounted. The lower part of valve body G has a seat SL where valve V3 is mounted. In between valve seat SU and valve seat SL there is an intermediate valve seat SI. An expansion spring J2 is urging valve V2 and valve V3 against seat SU and SL respectively. Valve V2 prevents soap from entering into water line WW. Valve V2 provides a way for water from water line WW to enter and accumulate in valve body G between seats SL and SU, keeping the water pressure in valve body G almost equal to the water pressure in water line WW.

When the apparatus is installed, soap is filled in the tank T through hole O. Soap will fill cylinder CC, bore It of piston PP and part of bore BB in plunger B. Piston PP will slide in the upper portion of sleeve S. Water pressure from water line WW will overcome the expansion force of spring J2 and push valve V3 away from seat SL, allowing water to rush to valve body G to fill it until the water pressure in valve body G will almost equal to the water pressure in water line WW.

In a first position, the dispenser can be used to dispense just soap. As can be seen from FIG. 1, if plunger B is depressed into cylinder CC such that valve V2 is not moved by piston PP, the presence of piston PP is cylinder CC causes an increase in pressure in cylinder CC which causes soap in cylinder CC to move valve 1 and cause soap to be spat out of plunger B.

Figure 2:
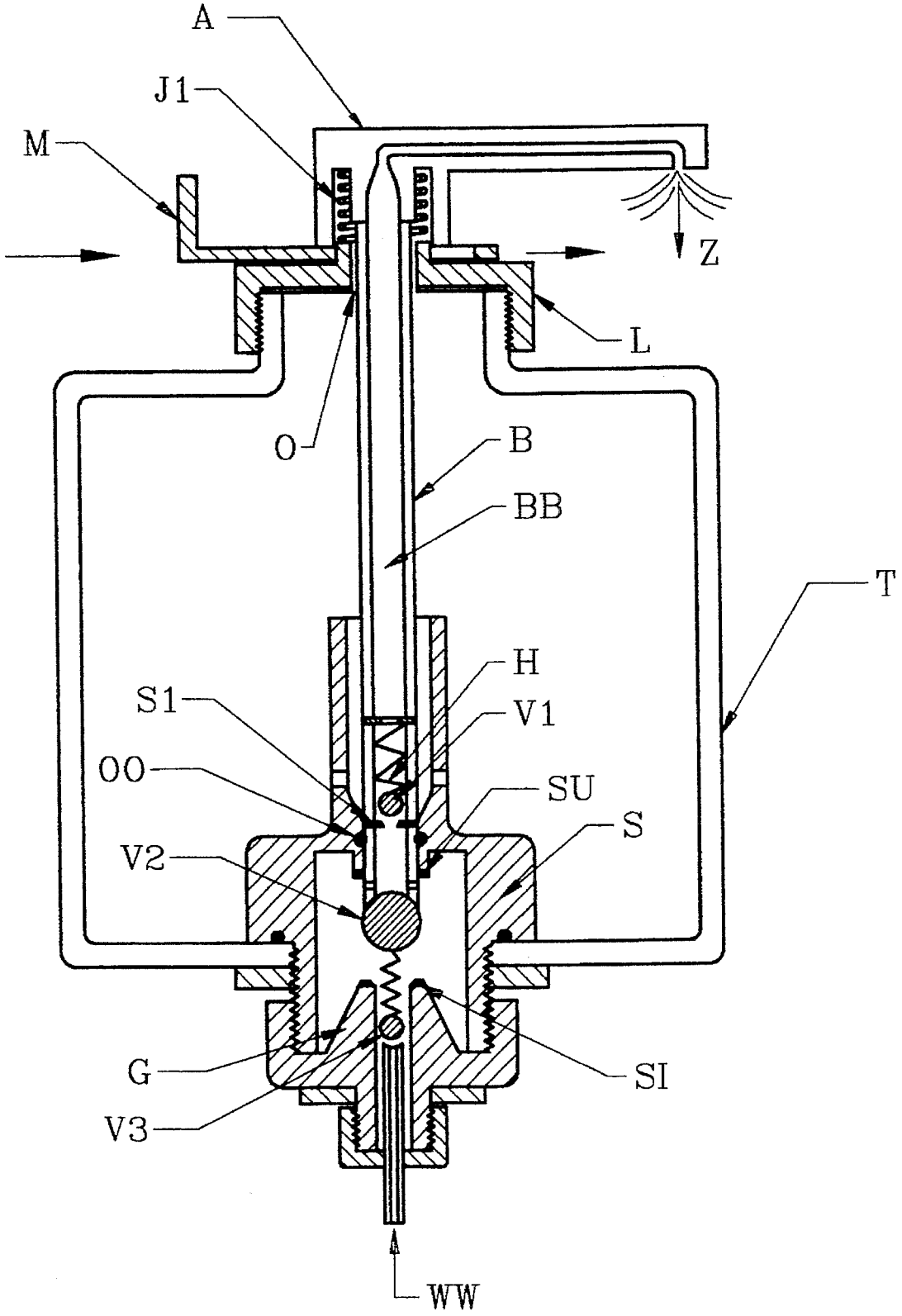
FIG. 2 illustrates the apparatus where the plunger is pressed to a second position which allows continuous water flow.

As illustrated in FIG. 2, when member M is adjusted to a first position, such that button A can only be depressed part of the way, spring J1 compresses, and plunger B pushes piston PP into cylinder CC finally to push valve V2 away from seat SU. In this second depressed position valve V2 is in between seat SU and seat SI. This will allow water from valve body G to rush into the bore H of piston PP, by moving valve VI away from seat S1. Water will not enter into tank T, it will only enter into bore It since piston PP and cylinder CC are slidingly fit, and also due to the presence of O ring OO. As water is leaving valve body G, water from water line WW will enter via valve V3 to equalize pressure between the water line and valve body G. Thus, so long as button A is depressed, pressurized water will continue flowing up bore BB. This will allow for a continuous cleaning of the piston, cylinder and valves, if required.

Figure 3:
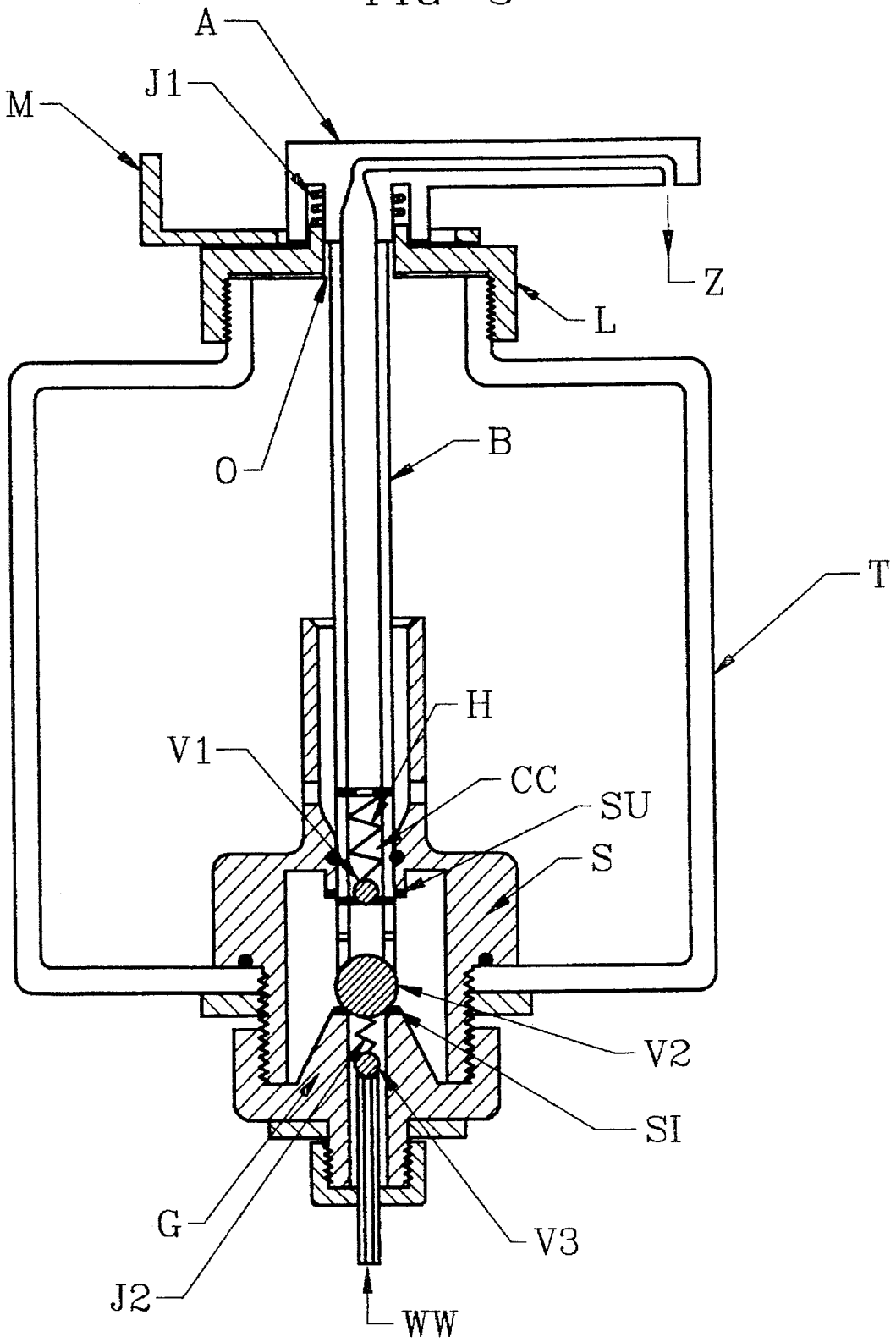
FIG. 3 illustrates the apparatus where the plunger is pressed to a third position which allows minimal water flow.

FIG. 3 will illustrate the apparatus when member M is adjusted to a second position which will allow button A to be fully depressed against plug L. In this third depressed position plunger B will push valve V2 away from seat SU and against seat SI. When valve V2 is seated on seat SI it prevents the water from water line WW from entering into valve body G. Consequently only a limited amount of water will clean the system. Only the pressurized water from valve body G will burst into bore H and will push the soap in bore BB out of nozzle Z. This second depressed position will provide a feature that will enable the user to have a minimal amount of water diluting the soap where the amount of water is sufficient to clean the system.

When the button A is released, spring J1 will expand, pulling plunger B up and out of cylinder CC, returning plunger B to slide in sleeve S. As plunger B moves up it will release its urging pressure off of valve V2, allowing the valve to return to seat SU. Once again water from line WW will overcome the force of spring J2 so that water will enter valve body G, leaving the system ready for further use.

Figure 4:
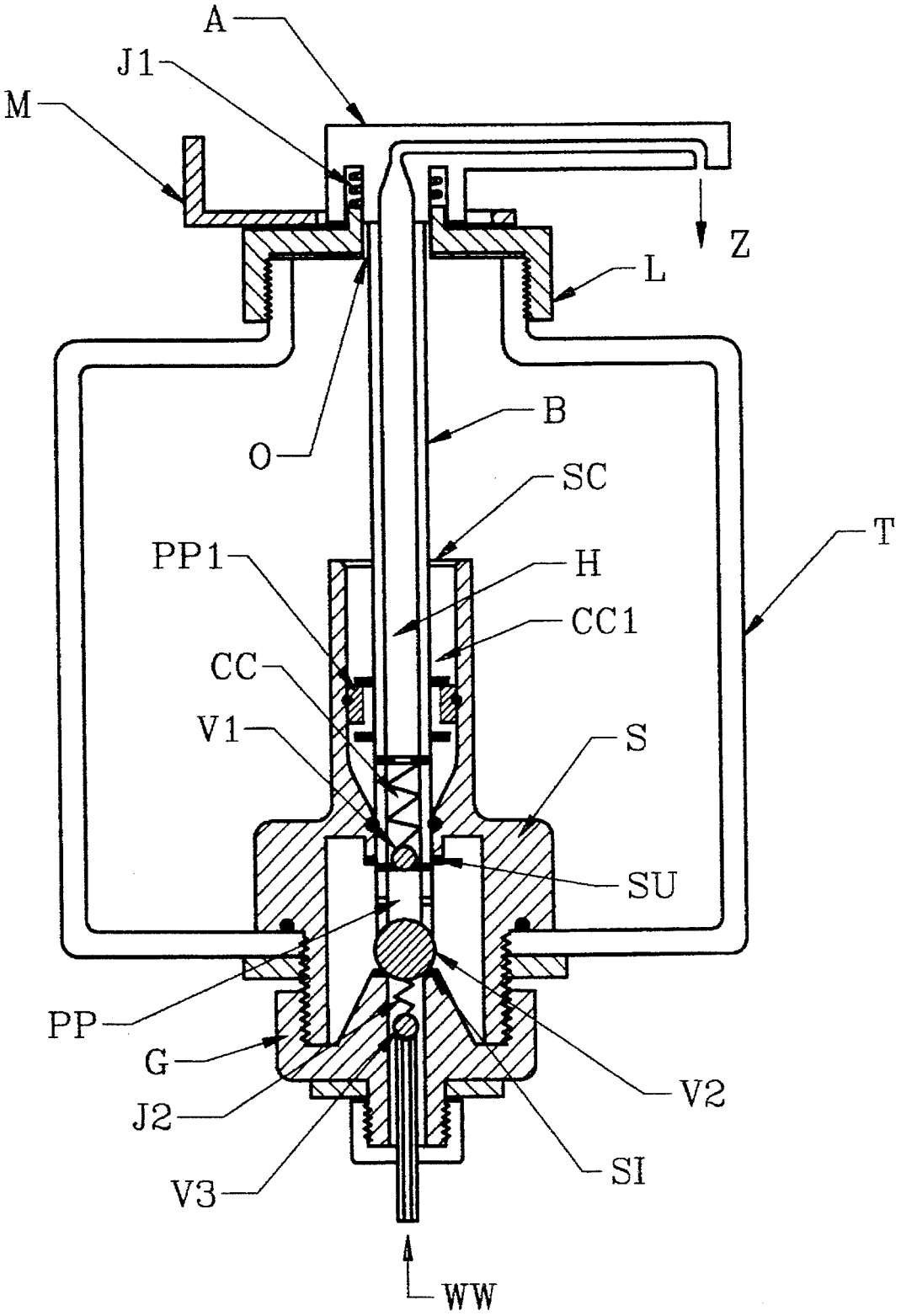
FIG. 4 illustrates the apparatus with a dual diameter cylinder and a dual diameter piston.

FIG. 4 will illustrate a dual diameter cylinder and dual diameter piston which will minimize the force needed to remove valve V2 from seat SU, and minimize the distance plunger B will need to travel in order to eject the maximum quantity of soap from the nozzle. Since pressurized water from water line WW is acting on valve V2, forcing it against seat SU, the user will have to overcome this opposing force when pressing button A. To minimize this force, the surface of valve V2 must be minimized. Thus, a small diameter cylinder CC is preferable at the bottom, with a corresponding small diameter piston PP. At the top, on the other hand, a large diameter cylinder CC1 is preferable, and correspondingly a large piston PP1 is necessary. Since the distance the plunger needs to travel should be minimized—in order to exert the least amount of work, and since the quantity of soap to be ejected should be sufficient, the upper cylinder CC1 should have a large diameter but be short. When the plunger B is not pressed, the upper piston PP1 will be maintained above the sleeve S to allow soap from the tank T to enter into the cylinders CC and CC1. These two pistons PP and PP1 can be built from one unit or from two units—in which case the small-diameter piston will slide in the large-diameter piston—where the small diameter piston is connected to plunger B. The large-diameter piston can slide up and down the small-diameter piston. The small-diameter piston will have a stopper above and a stopper below the large-diameter piston. When the plunger will be depressed it will move the upper stopper against the large-diameter piston pushing the piston down, and when the plunger will be released, the lower stopper will urge the large-diameter piston up, cuasing the large diameter piston to slide up. When plunger B is not pressed, soap will enter into the cylinders via the space between the pistons. When the plunger B will be in a depressed position it will move the upper stopper against the larger-diameter piston acting as a valve which closes off communication of soap from the tank to the cylinders. As plunger B moves further down, the upper stopper will compress the soap in the cylinders causing the soap to be pushed out through the bore in piston PP.

This specification is only one way of building this apparatus and is not intended to be an exhaustive description or the only description of how to build an apparatus that has a self cleaning mechanism.

I claim:

1. A self cleaning liquid soap dispenser comprising;

a tank for storing soap, said tank comprising an opening at the top for refilling the tank with soap, and an opening at the bottom which is adapted to a pressurized water line, said tank further comprising a plug adapted to the top;

a plunger having a bore therethrough, said bore terminating in a nozzle protruding from said plug and out of said container, for ejecting soap from said container when the plunger is depressed;

a piston means having a bore therethrough mounted on said plunger, the plunger and piston having a continuous passage therethrough designed to permit flow of fluid, said passage having a first valve means for providing selective communication from the tank to the user;

a cylinder body means having a bore therethrough, said cylinder body means is mounted in the tank for slidingly receiving the piston means such that when the plunger is not pressed soap in the tank fills the cylinder body means and when the plunger is in a first depressed position soap is spat out from the cylinder body means into said passage via the first valve means, the soap being ejected to the user;

a second valve means mounted in the cylinder body for providing selective communication between the water line and the cylinder body means such that when the plunger is not pressed, the second valve means remains closed so that no water enters into said passage, further, when said plunger is depressed to a second depressed position, the plunger will push said second valve means to open position so that water from the water line will continuously enter into the cylinder body means, pushing the soap in the plunger out to the user as the water is continuously rinsing the piston, the cylinder the passage, and the first and second valve means.

2. A self cleaning liquid soap dispenser as in claim 1 further comprising;

a valve body having a bore therethrough, said valve body having an upper portion adapted to be connected to said cylinder body, and having a lower portion adapted to be connected to the pressurized water line, such that when the plunger is in a third depressed position the second valve means will close communication between said water line and said valve body so that a single spurt of pressurized water rushes into said piston to eject the soap through the nozzle.

3. A self cleaning liquid soap dispenser as in claim 2 further comprising;

a third valve means mounted in the valve body for providing selective communication between the water line and the valve body, such that water from the line can enter the valve body but prevent soap from the tank from entering the water line, so that water from the water line will maintain the valve body filled with water when the plunger is not pressed and when the plunger is in a second depressed position.

4. A self cleaning liquid soap dispenser as in claim 1, 2 or 3 further comprising;

returning means for returning the piston from a depressed position to a non-depressed position when the plunger is not pressed;

an upper valve seat in the cylinder body designed for receiving the second valve means when the plunger is not pressed.

5. A self cleaning liquid soap dispenser as in claim 2 or 3 further comprising;

an intermediate valve seat in the valve body designed for receiving the second valve means when the plunger is depressed to the third depressed position.

6. A self cleaning liquid soap dispenser as in claim 3 further comprising;

a lower valve seat in the valve body designed for receiving the third vane means.

7. A self cleaning liquid soap dispenser as in claim 3 or 6 further comprising;

a spring urging the second valve means against the upper valve seat and further urging the third valve means against the lower valve seat.

8. A self cleaning liquid soap dispenser as in claim 3 further comprising;

an upper valve seat in the cylinder body designed for receiving the second valve means when the plunger is not used;

a lower valve seat in the valve body designed for receiving the third valve means when no water is entering from the water line;

a spring urging the second valve means against the upper valve seat and further urging the third valve means against the lower valve seat such that in a third depressed position the water pressure from the line can not further compress the spring preventing water form entering the valve body.

9. A self cleaning liquid soap dispenser as in claim 2 or 3 further comprising;

a projecting member mounted on the tank such that in a second depressed position said member is located in the path of motion of the plunger so that the member prevents said plunger from moving the second valve means to the intermediate seat, and in a third depressed position said member moves away from the path of motion of the plunger so that the member permits said plunger to move the second valve means to the intermediate seat.

10. A self cleaning liquid soap dispenser as in claim 1, 2 or 3 wherein said cylinder body means comprises a dual diameter cylinder such that the smaller diameter cylinder is lower than the upper diameter cylinder, so that the second valve means is mounted in the lower diameter cylinder;

said piston means comprises a dual diameter piston, such that the smaller diameter piston is slidingly receivable within the smaller diameter cylinder and the larger diameter piston is slidingly receivable within the larger diameter cylinder, such that a small force on the plunger will be able to move the first valve means to allow a sufficient quantity of soap to be ejected.

* * * * *